US008687339B2

(12) United States Patent
Wang

(10) Patent No.: US 8,687,339 B2
(45) Date of Patent: Apr. 1, 2014

(54) SAFETY CONTROL STRUCTURE FOR HEATER WIRE

(76) Inventor: Ching-Chuan Wang, Keelung (TW)

( * ) Notice: Subject to any disclaimer, the term of this patent is extended or adjusted under 35 U.S.C. 154(b) by 163 days.

(21) Appl. No.: 13/226,007

(22) Filed: Sep. 6, 2011

(65) Prior Publication Data

US 2012/0299689 A1 Nov. 29, 2012

(30) Foreign Application Priority Data

May 23, 2011 (TW) ..... 100117939 A

(51) Int. Cl.
*H01H 37/02* (2006.01)

(52) U.S. Cl.
USPC ..... 361/106

(58) Field of Classification Search
USPC ..... 361/106
See application file for complete search history.

(56) References Cited

U.S. PATENT DOCUMENTS 3,697,863 A * 10/1972 Kilner ..... 361/106
4,251,718 A * 2/1981 Cole ..... 219/501
5,317,869 A * 6/1994 Takeuchi ..... 60/300
5,861,610 A 1/1999 Weiss
6,300,597 B1 10/2001 Lee
6,310,322 B1 10/2001 Yang et al.
6,768,086 B2 7/2004 Sullivan et al.
7,180,033 B2 * 2/2007 Morgandi ..... 219/212
7,180,037 B2 * 2/2007 Weiss ..... 219/505
2003/0173345 A1 * 9/2003 Irwin et al. ..... 219/212
2010/0051604 A1 * 3/2010 Davidov et al. ..... 219/488
2012/0199574 A1 * 8/2012 Weiss et al. ..... 219/481

* cited by examiner

*Primary Examiner* — Jared Fureman
*Assistant Examiner* — Kevin J Comber
(74) *Attorney, Agent, or Firm* — Muncy, Geissler, Olds & Lowe, P.C.

(57) ABSTRACT

A safety control structure for heater wire comprises a switch, a first heating wire, a second heating wire, and an over-current protection element, which are sequentially connected in series connection. An insulation and fusible layer is interposed between the first heating wire and the second heating wire. Accordingly, under normal condition, the switch is triggered by triggering the circuit, so as to have the first heating wire and the second heating wire then be heated up within a preset temperature range. When the first heating wire and the second heating wire produce exceptionally high temperatures to fuse the insulation and fusible layer, the current is increased instantaneously because the first heating wire and the second heating wire are short-circuited. Therefore, the circuit is interrupted by the over-current protection element to show a broken circuit status in order to stop heating up.

7 Claims, 3 Drawing Sheets

SAFETY CONTROL STRUCTURE FOR HEATER WIRE

BACKGROUND OF THE INVENTION

1. Field of Invention

The present invention relates to a safety control structure for heating wire and, more particularly, to a safety control structure which can interrupt the power and stop heating up in order to ensure safety when the heater wire produces exceptionally high temperature, and is suitable for use with heating devices such as electric blankets and hot packs.

2. Description Of The Prior Art

Heating devices such as hot packs are very popular in the market. The heating of a heater wire is interrupted automatically after it is heated up to a temperature preset by the user to ensure safety, so that the heating temperature of the heating device can be maintained within a preset range so that the heating device can be used as a hot compress and its safety can be ensured.

In order to control the temperature effectively, U.S. Pat. No. 5,861,610 employs a positive temperature coefficient (PTC) element as the sensing wire to sense the changes in temperature, and a heater wire for heating up and temperature control. These techniques have already been disclosed in U.S. Pat. Nos. 6,300,597, 6,310,322 and 6,768,086. While U.S. Pat. No. 7,180,037 employs a time difference determinator circuit to continuously measure the phase-shift time of zero cross signals, and a controller to operate continuously to output control signals to render the circuit connected or interrupted. As a result, both heating up and temperature control are achieved.

The above-mentioned circuit structures mainly employ sensors and controllers to control the temperature. Nevertheless, the circuits for temperature control are rather complicated. The heater wire will continue to heat up when the electrical elements such as sensors and controllers are broken, which is dangerous to users.

The present invention of a safety control structure for heater wire aims to overcome the above drawbacks and disadvantages by ensuring the safety when the heater wire produces exceptionally high temperature.

SUMMARY OF THE INVENTION

The present invention aims to provide a safety control structure for heater wire. An insulation and fusible layer is interposed between two heating wires which are connected in series. A switch is connected to one end of one of the two heating wires, and an over-current protection element is connected to one end of the other heating wire, so that the insulation and fusible layer is fused under exceptionally high temperature. When the two heating wires are short-circuited, the current is increased instantaneously to allow the over-current protection element to interrupt the circuit, and thus the power is cut off to stop the heating up to ensure safety.

In order to achieve the above-mentioned object, the present invention of a safety control structure for heater wire comprises a heater wire, a switch, and an over-current protection element. The heater wire includes a first heating wire, a second heating wire, an insulation and fusible layer interposed between the first and the second heating wires, as well as a coating layer which covers the second heating wire and the insulation and fusible layer. The first heating wire and the second heating wire respectively include a first end and a second end. The first end of the first heating wire is coupled to the second end of the second heating wire. One end of the switch is coupled to the second end of the first heating wire, and another end of the switch is coupled to a pole of a power. The switch is either in closed or open status according to the triggering of the circuit. One end of the over-current protection element is coupled to the first end of the second heating wire, while its another end is coupled to an opposite pole of the power.

Accordingly, when the insulation and fusible layer is fused by the exceptionally high temperature produced by the first heating wire and the second heating wire, the first heating wire and the second heating wire are short-circuited to decrease the overall resistance and to increase the current instantaneously, so as to allow the over-current protection element to interrupt the circuit, and consequently the circuit is broken in order to stop the heating.

When it is embodied, the switch, the first heating wire, the second heating wire, and the over-current protection element are sequentially connected in series.

When it is embodied, the over-current protection element is a polymer positive temperature coefficient (PPTC) thermistor.

The present invention will become more fully understood by reference to the following detailed description thereof when read in conjunction with the attached drawings.

DETAILED DESCRIPTION OF THE INVENTION

Figure 1:
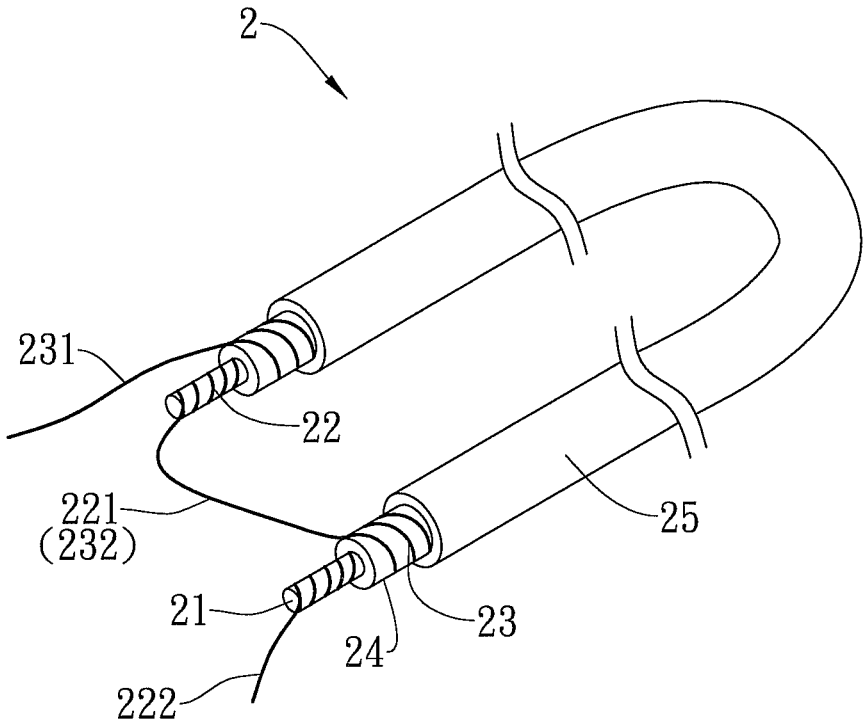
FIG. 1 is a perspective view of a safety control structure for heater wire of the present invention.
Figure 2:
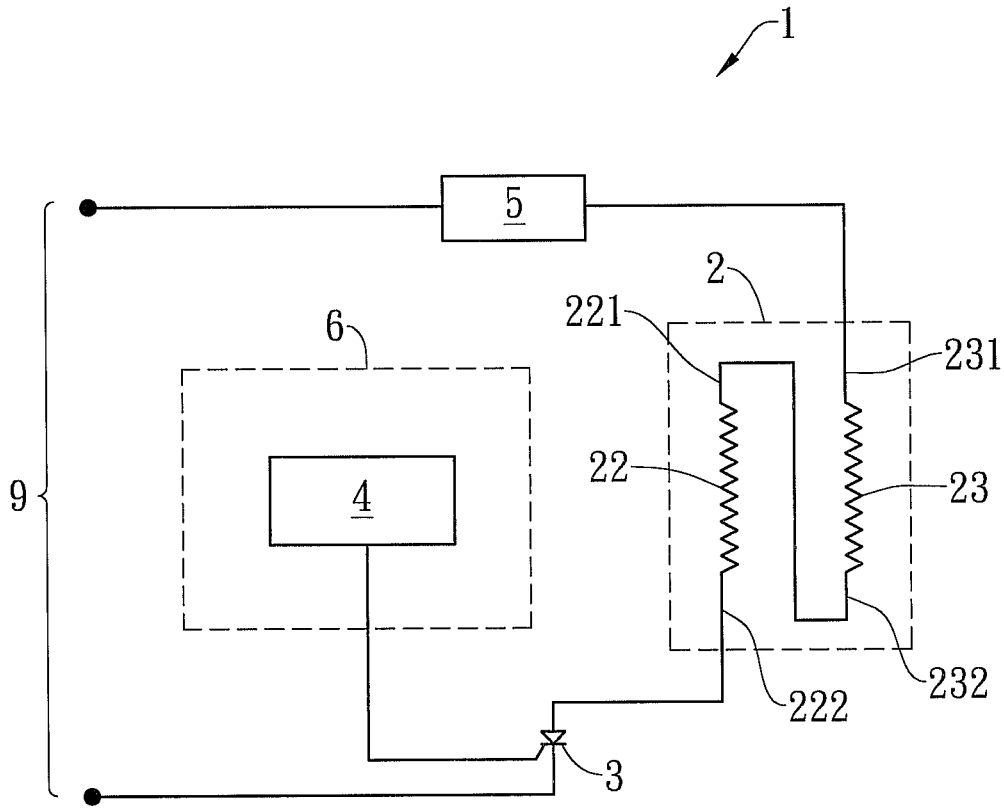
FIG. 2 is a circuit diagram of a preferred embodiment of the present invention.

According to the present invention, FIGS. 1 and 2 shows a preferred embodiment of a safety control structure for heater wire 1, which comprises a heater wire 2, a switch 3, a trigger circuit 4, and an over-current protection element 5. The heater wire 2 can be disposed in heating appliances such as electric heaters and hot packs as a heater element.

The heater wire 2 includes a core 21, a first heating wire 22, a second heating wire 23, an insulation and fusible layer 24 as well as a coating layer 25. The first heating wire 22 is coiled around the outer surface of the core 21. The insulation and fusible layer 24 is made of polyethylene (PE) for coating on the outer surface of the first heating wire 22 and the core 21. When it is being embodied, the insulation and fusible layer 24 can also be made of other materials having the characteristics of insulation and are fusible under specific high temperatures. The second heating wire 23 is coiled on the outer surface of the insulation and fusible layer 24, so that the insulation and fusible layer 24 is interposed between the first heating wire 22 and the second heating wire 23. The coating layer 25 covers the second heating wire 23 as well as the insulation and fusible layer 24.

The first heating wire 22 and the second heating wire 23 respectively have a resistance. The resistance of the first heating wire 22 is equal to that of the second heating wire 23. The first heating wire 22 and the second heating wire 23 respectively have a first end 221, 231 and a second end 222, 232. The first end 221 of the first heating wire 22 is coupled to the second end 232 of the second heating wire 23.

When a power 9 is an alternating current (AC) power, the switch 3 is a silicon controlled rectifier (SCR). The switch 3 can also be a bidirectional thyristor (TRIAC) and the like.

One end of the switch 3 is coupled to the second end 222 of the first heating wire 22, while the other end of the switch 3 is coupled to a pole of the power 9. The gate of the switch 3 is connected to the trigger circuit 4 which is controlled by a processor 6. The trigger circuit 4 is triggered to either turn on or turn off the switch 3, so that the first heating wire 22 and the second heating wire 23 are maintained within a preset temperature. When it is embodied, the power can also be a direct current (DC) power, and the switch 3 can also be a metal-oxide semiconductor field-effect transistor (MOSFET).

The over-current protection element 5 is a polymer positive temperature coefficient (PPTC) thermistor. The over-current protection element 5 can also be a ceramic positive temperature coefficient (PPTC) thermistor, or other elements or circuits which can interrupt the circuit to protect the circuit under over-current status. One end of the over-current protection element 5 is coupled to the first end 231 of the second heating wire 23, while the other end of the over-current protection element 5 is coupled to an opposite pole of the power 9, so that the switch 3, the first heating wire 22, the second heating wire 23, and the over-current protection element 5 are connected in series sequentially.

Figure 3:
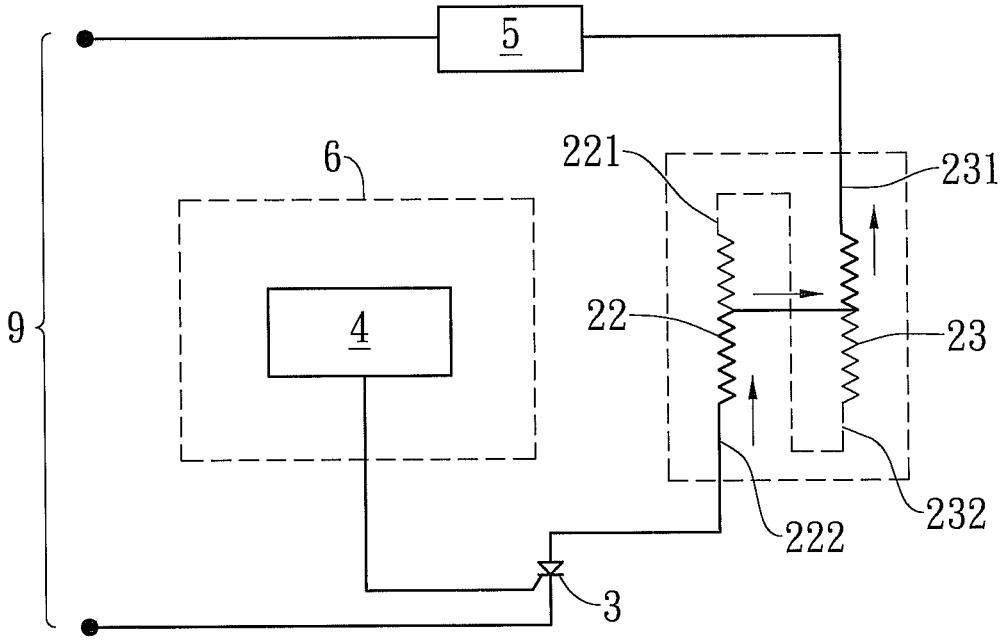
FIG. 3 is a circuit diagram of a preferred embodiment of the present invention under a short-circuit status.

Therefore, under heating up condition, by triggering the trigger circuit 4 and controlling the processor 6, the switch 3 is either turned on or interrupted, so as to control the loop for the heating up of the first heating wire 22 and the second heating wire 23. Referring to FIG. 3, under unpredictable circumstances such as the processor 6 or the switch 3 is broken so that the switch 3 is turned on all the time, the first heating wire 22 and the second heating wire 23 will continue to heat up to reach so high a temperature of approximately 120 □ that the insulation and fusible layer 24 is fused to allow the first heating wire 22 in contact with the second heating wire 23 to be in a short-circuit status.

At this point, under a fixed voltage, because the resistance of the first heating wire 22 equals to that of the second heating wire 23, the resistance of the first heating wire 22 and the resistance of the second heating wire 23 will be decreased to half of the original total resistance regardless of whether the first end 221 of the first heating wire 22 is in contact with the first end 231 of second heating wire 23, the second end 222 of the first heating wire 22 is contact with the second end 232 of the second heating wire 23, or any portion between the first end 221 and the second end 222 of the first heating wire 22 is in contact with any portion between the first end 231 and the second end 222 of the second heating wire 23.

Based on the formula that current equals to voltage divided by resistance, under a fixed voltage, when the total resistance is decreased to half of the original value, the current will be increased to two times of the original value. When the current is increased instantaneously, the circuit will be interrupted because of the characteristics of the polymer positive temperature coefficient (PPTC) thermistor, so that the first heating wire 22 and the second wire 23 will stop being heated up.

For instance, the over-current value of the over-current protection element 5 is set to be 0.8 amperes (A), and the resistance for the first heating wire 22 and the second heating wire 23 is 130 ohms (Ω) respectively. Under a voltage of 110 volts (V), the value of the current flowing through the over current protection element 5 equals 110 divided by 260=0.42A. At this time, the over-current protection element 5 operates normally to allow the current to flow through. When the first heating wire 22 and the second heating wire 23 are short-circuited, the total resistance of both the first heating wire 22 and the second heating wire 23 is decreased to 130Ω, and thus the current reaching the over current protection element 5 is instantaneously increased to 0.85A (110 divided by 130), which already exceeds the preset current of 0.8A for the over current protection element 5. Therefore, the over current protection element 5 will be interrupted in a broken circuit status. Once the malfunction is recovered, the polymer positive temperature coefficient (PPTC) thermistor will be restored to low resistance status due to its own characteristics, and the current is allow to flow through again.

When it is embodied, the resistance of the first heating wire 22 can be slightly larger or smaller than the resistance of the second heating wire 23, but it is not appropriate to have a big difference. The difference of the resistance values of the two heating wires is limited by the preset flow of current for the over-current protection element 5. Therefore, when there is only a little difference between the resistance of first heating wire 22 and the resistance of the second heating wire 23, the characteristics of the polymer positive temperature coefficient (PPTC) thermistor can be utilized to react speedily in order to ensure safety.

Therefore, the safety control structure for heater wire according to the present invention has the following advantages:

1. The present invention can allow the heater wire to directly stop heating up by the changes in current when the heater wire reaches an exceptionally high temperature. Therefore, it can react speedily and can ensure safety at the same time.
2. The present invention can connect the circuit with the overall changes in current, so as to automatically determine if it needs to maintain the heating status. Therefore, the structure is simple and can reduce the production costs at the same time.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A safety control structure for heater wire, comprising:

a heater wire which includes a first heating wire, a second heating wire, an insulation and fusible layer interposed between said first heating wire and said second heating wire, as well as a coating layer which covers said second heating wire and said insulation and fusible layer, wherein, said first heating wire and said second heating wire each includes a first end and a second end; the first ends of the first and the second heating wire are at one end of the heater wire, while the second ends of the first and the second heating wire are at another end of the heater wire; said first end of said first heating wire is coupled to said second end of said second heating wire;

a switch with one end coupled to said second end of said first heating wire and with another end coupled to a pole of a power, and said switch being triggered by a trigger circuit to either show turned on or interrupted status; and an over current protection element, with one end coupled to said first end of said second heating wire and with another end coupled to an opposite pole of said power, by which said insulation and fusible layer is fused when said first heating wire and said second heating wire produce exceptionally high temperatures, and the current is increased instantaneously when said first heating wire and said second heating wire are short-circuited, so that the circuit is interrupted by said over-current protection element to show interrupted status, wherein the resistance of said first heating wire is substantially equal to the resistance of said second heating wire, and wherein when said first heating wire and said second heating wire are short-circuited the current increased to substantially 2 times an original current value.

2. The safety control structure for heater wire as claimed in claim 1, wherein, said switch, said first heating wire, said second heating wire, and said over current protection element are connected sequentially in series.

3. The safety control structure for heater wire as claimed in claim 1, further comprising a core, wherein said first heating wire is coiled around the outer surface of said core.

4. The safety control structure for heater wire as claimed in claim 1, wherein said power is an alternating current (AC) power and said switch is a thyristor.

5. The safety control structure for heater wire as claimed in claim 1, wherein said power is a direct current (DC) power and said switch is a metal-oxide semiconductor field-effect transistor (M0SFET).

6. The safety control structure for heater wire as claimed in claim 1, wherein said over current protection element is a polymer positive temperature coefficient (PPTC) thermistor.

7. The safety control structure for heater wire as claimed in claim 1, wherein said insulation and fusible layer is made of polyethylene (PE).

* * * * *